United States Patent [19]

Anderson

[11] 3,948,410

[45] Apr. 6, 1976

[54] REFRIGERATOR CABINET

[75] Inventor: Earl Anderson, Greenville, Mich.

[73] Assignee: White Consolidated Industries, Inc., Cleveland, Ohio

[22] Filed: Aug. 12, 1974

[21] Appl. No.: 496,820

[52] U.S. Cl. ..... 220/9 G; 220/62; 312/214

[51] Int. Cl.[2] ..... B65D 25/18; F25D 11/00

[58] Field of Search ..... 220/9 F, 9 G, 62, 69; 312/214

[56] References Cited

UNITED STATES PATENTS

| | | | |
|---|---|---|---|
| 2,040,399 | 5/1936 | Nauert | 220/9 G |
| 2,180,886 | 11/1939 | Thomas | 220/62 X |
| 2,205,779 | 6/1940 | Forsthoefel | 220/9 G |
| 2,386,935 | 10/1945 | Dailey | 220/62 X |
| 2,423,863 | 7/1947 | Wales | 220/62 X |
| 2,438,108 | 3/1948 | Barler et al. | 220/62 X |
| 2,576,208 | 11/1951 | Benson | 220/9 G X |
| 2,769,679 | 11/1956 | Wiseman | 312/214 X |
| 3,221,085 | 11/1965 | Rill, Jr. et al. | 312/214 X |

FOREIGN PATENTS OR APPLICATIONS

| | | | |
|---|---|---|---|
| 173,610 | 12/1960 | Sweden | 312/214 |
| 633,899 | 1/1962 | Canada | 312/214 |

*Primary Examiner*—William Price
*Assistant Examiner*—Stephen Marcus
*Attorney, Agent, or Firm*—Strauch, Nolan, Neale, Nies & Kurz

[57] ABSTRACT

A refrigerator cabinet construction having, as major components, a one-piece wraparound outer shell, a base assembly preferably of one-piece construction, a liner, a back cover plate, and insulation surrounding said liner, said components being mechanically secured together without welding. The outer shell, base and back cover may be fabricated from prefinished sheet stock.

8 Claims, 6 Drawing Figures

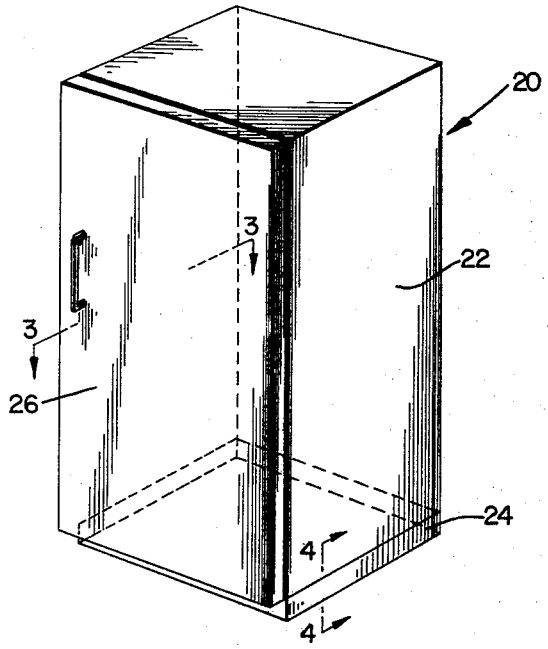
FIG. 1
FIG. 2
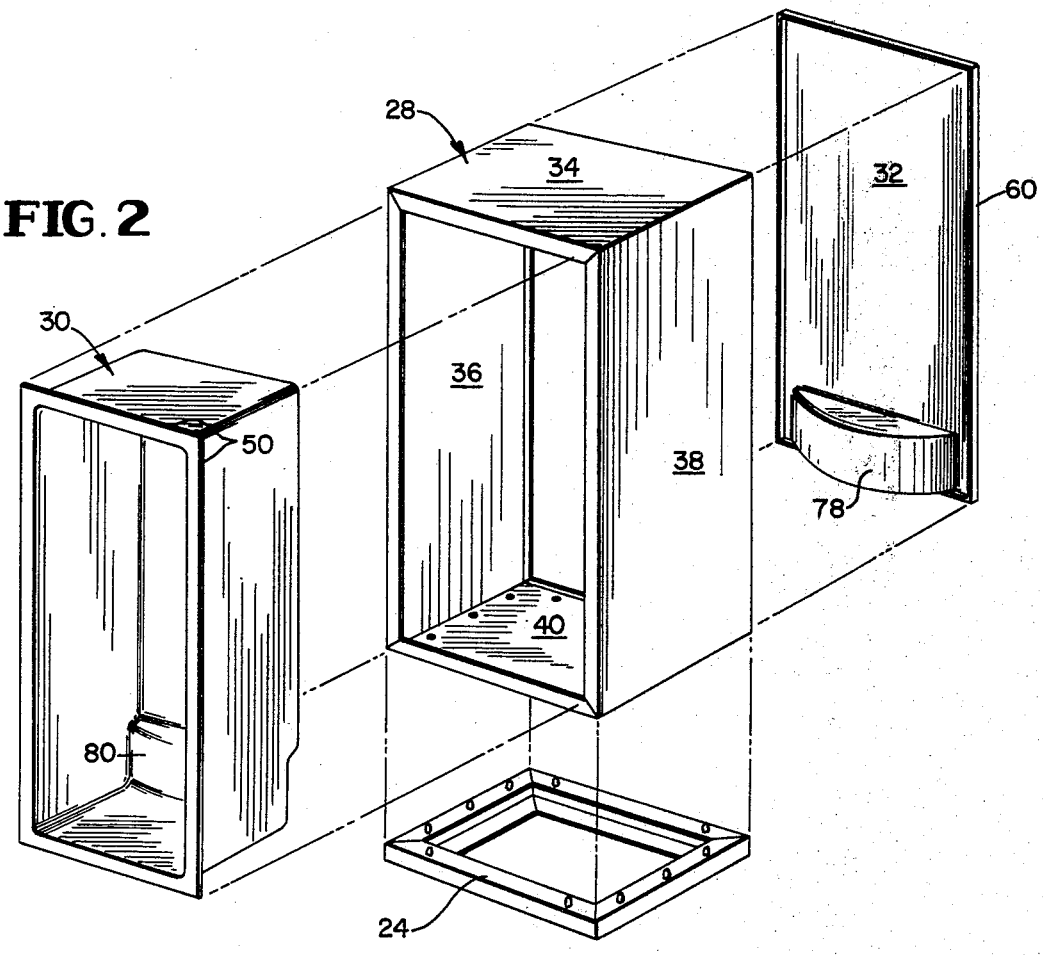

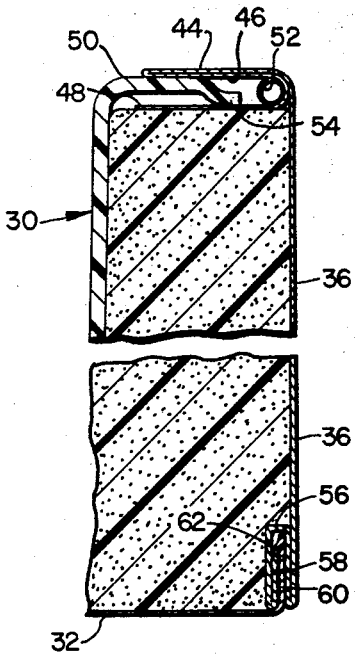
FIG. 3
FIG. 6
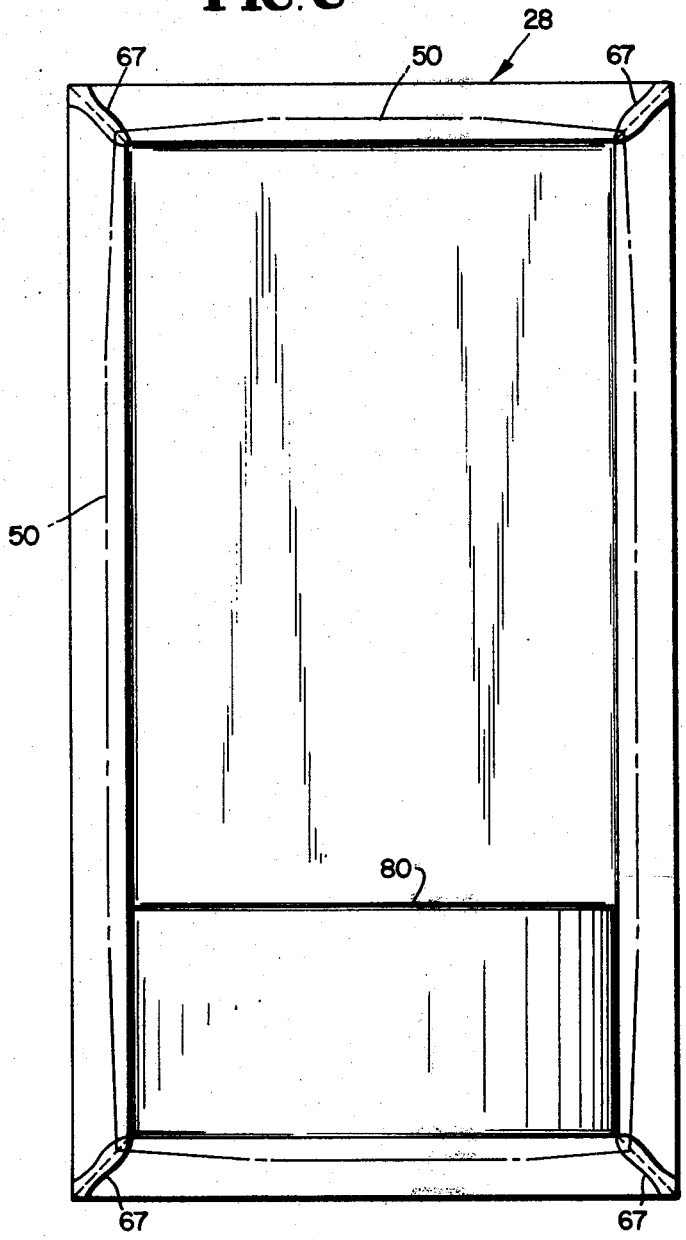
FIG. 4
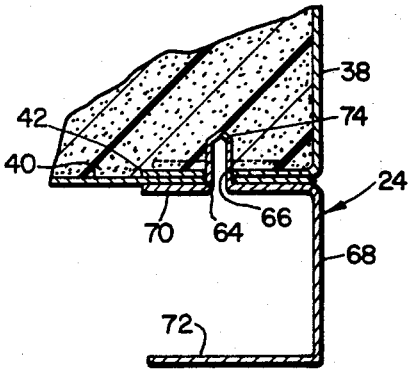
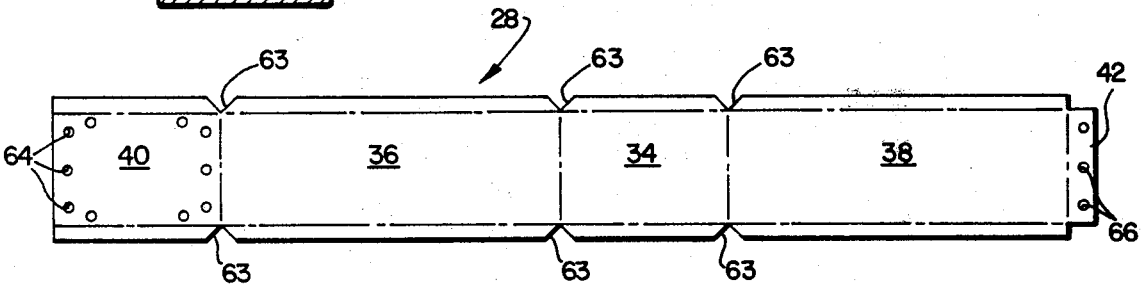
FIG. 5

REFRIGERATOR CABINET

BACKGROUND OF THE INVENTION

Refrigerator cabinets as heretofore produced normally comprise over twenty separate parts which are assembled by welding and with a variety of mechanical fasteners. Despite the use of automation and the refinement of assembly techniques, the manufacture and assembly of these many parts require a substantial number of manual operations and the cost of manufacturing refrigerator cabinets has remained relatively high.

The design, manufacture, production scheduling and inventory control of the many components of prior refrigerator cabinets has also contributed significantly to the overall cost of the finished product.

Further, the employment of welding in the manufacture of refrigerator cabinets has inhibited the use of cost-saving prefinished materials, and, when such materials have been used, time-consuming and costly hand finishing operations have been required to avoid an unacceptable rate of scrap production.

SUMMARY OF THE INVENTION

The present invention, by the provision of unique simplified cabinet structure, comprising only four major components and simplified manufacturing and assembly methods, which completely eliminate the need for welding operations, materially reduces the cost of manufacture of refrigerator cabinets.

In accordance with the present invention the basic cabinet includes a one-piece wraparound outer sheet metal shell which forms the top, sides and bottom walls of the cabinet, a base assembly, also preferably of one-piece construction, a plastic liner, and a back cover plate. The shell, base, and back cover may be formed from prefinished sheet stock.

The ends of the outer shell are overlapped at one lower corner of the cabinet to provide a seam or joint overlying a horizontal flange on the base assembly, the flange including integral fastener means, described below, which lock the base and shell together, each part holding the other part in final assembled relation. The outer shell has integral flange structure extending around its front and rear edges into which the liner and back cover, respectively, are inserted and held in place without separate fastener means. The basic cabinet is then completed by insulating the space between the liner and the outer shell and back cover, the insulation being applied with conventional foam-in-place techniques.

Thus, it is the principal purpose and object of the present invention to provide improved and highly simplified refrigerator cabinet constructions which afford significantly reduced manufacturing costs.

It is a further object to provide novel refrigerator cabinet constructions which, by the elimination of all welding operations permit the use of prefinished materials when desired without the necessity of time-consuming and expensive hand finishing operations or the rejection of finished parts as scrap.

It is also an object of the present invention to provide improved and simplified refrigerator cabinet constructions which, by reducing the number of parts and assembly operations, permits the use of simplified assembly line procedures.

Further objects and advantages will become apparent as the description proceeds.

THE DRAWINGS

FIG. 1 is a perspective view of a typical refrigerator cabinet incorporating the present invention;

FIG. 2 is an exploded view showing the principal components of the refrigerator cabinet prior to assembly;

FIGS. 3 and 4 are sections taken along lines 3—3 and 4—4 of FIG. 1 showing details of construction;

FIG. 5 illustrates the blank from which the outer shell is formed; and

FIG. 6 is a front view of the refrigerator cabinet of FIG. 1 illustrating the relationship between the liner and the outer cabinet shell.

DESCRIPTION OF PREFERRED EMBODIMENTS

For illustrative purposes the invention is shown as applied to an upright single door household refrigerator indicated generally at 20. It will be understood, however, that the invention may be utilized in the construction of a wide variety of refrigerator cabinets including, for example, refrigerators having separate doors for the fresh food and frozen food compartments arranged vertically one above the other or side by side or for food freezers.

With more particular reference to FIG. 1, the refrigerator 20 comprises a main insulated cabinet 22 supported on a base 24, the front of the cabinet being closed by a conventional door structure 26 which may be a single unit, as illustrated, or may be a dual unit depending upon the internal configuration of the refrigerator, the details of which do not form a part of the present invention and have been omitted for clarity.

The major components, which comprise the cabinet, are illustrated separately in FIG. 2 and include, in addition to the base 24, an outer shell 28, a plastic liner 30 and a rear panel 32.

It is a feature of the invention that the outer shell 28 is formed from a single piece of sheet metal preferably prefinished with the usual vinyl or enamel coating. The shell forms the top, side, and bottom walls 34, 36, 38 and 40, respectively, of the insulated portion of the cabinet.

As shown in FIG. 4 the end edges of the shell are joined at one lower corner of the cabinet, the lower edge of the side wall 38 being inturned to form a flange 42 overlying the end of the bottom shell wall 40 to form a seam or joint held together as described below.

As shown in FIG. 3 the front and rear edges of the shell 28 are formed to receive and retain the liner 30 and the back cover plate 32 without separate attachment means. With continued reference to FIG. 3, the forward edge of the shell 28 is turned inwardly in the form of an S-shaped section, the outer leg 44 providing a flat surface extending around the cabinet against which the door 26 seals. The two inner legs 46 and 48 of the S-shaped section provide a recess for the reception of a peripheral flange 50 formed integrally with the plastic liner 30. Also received between the legs 46 and 48 is a hot gas tube 52 connected to the refrigeration system, the tube extending around the top and two sides of the forward edge of the cabinet to prevent the accumulation of moisture at the front face of the cabinet.

To insure a tight friction fit and seal between the parts, the outermost edge of the flange 50 is provided with an offset portion 54 which engages the innermost leg 48 of the S-shaped section while the main body of the flange engages the center leg 46 of the section.

At its rear edge the shell is formed to provide a U-shaped section 56 with an inturned center leg 58. Received in U-shaped section is a flange 60 which extends around the periphery of the rear panel 32. A plurality of locking tabs 62, struck out from the body of the flange 60, extend over the inner end of the inner leg 58 to hold the parts in assembled relation after the rear panel is snapped into place.

In the manufacture of the shell 28 a piece of prefinished flat sheet stock is first punched or die cut to the form shown in FIG. 5. The flange portions along the forward and rearward edges of the shell are then formed after which the shell is bent along the dotted lines and brought into essentially its final configuration. The side edges of the blank from which the shell is formed are suitably notched as at 63 to accommodate the bending and to form smooth corner joints as shown in FIG. 2. When the shell is brought to final configuration as shown in FIG. 2, openings 64 and 66, punched out of the panel 40 and flange 42, respectively, are brought into alignment as shown in FIG. 4.

Plastic corner pieces 67 as shown in FIG. 6 are then snapped into place to cover the exposed corner joints on the front face of the shell.

The base 24, which is also of one-piece construction is formed in similar fashion from a sheet of prefinished stock. When formed in final configuration it is generally of U-shaped section having a main vertical leg 68 and upper and lower parallel inturned sections 70 and 72, respectively. Prior to the final bending operations, a plurality of hat-shaped projections 74 are struck upwardly from the upper flange 70, the hat-shaped sections being equal in number and spacing and slightly smaller in diameter than the openings 64 and 66 formed in the cabinet shell.

After the shell and base are formed to final configuration, they are assembled as shown in FIG. 4 with the hat-shaped projections extending through the aligned openings in the shell. The hat shaped projections are then deformed by a stamping operation to the dotted line configurations shown in FIG. 4, thus simultaneously locking the ends of the shell together, locking the base to the shell, and locking the base in final configuration. Preferably the base is so arranged that its ends meet at a rear corner of the refrigerator for reasons of appearance.

After assembly of the base to the shell, tubing for the refrigeration system is assembled between legs 46 and 48 of the formed front edge of the shell as shown in FIG. 3.

The plastic liner 30, which is also of one-piece construction and is formed in accordance with conventional methods, is then installed from the front of the cabinet by snapping the flange 50 into the front cabinet flange construction. To facilitate this operation the flange 50 is formed to the configuration shown in FIG. 6, being of reduced depth adjacent the corners of the cabinet. When the liner is to be fitted into the shell the liner is deformed by pressing the sides inwardly, thus foreshortening the liner sufficiently to permit the outer edge of the flange 50 to pass inwardly of the inner edge of the shell flange structure. When the liner is released it snaps into the position shown in FIG. 6, the liner being securely held in position and forming a tight peripheral seal.

After assembly of the liner, the rear panel is snapped into place.

The basic cabinet structure is then completed by injecting liquid foam components through suitable openings provided in the rear panel wall in accordance with conventional techniques to fill the entire space between the liner and the shell and between the liner and the rear panel with insulation which, upon hardening, also contributes substantially to the overall structural rigidity of the cabinet structure.

The door structure 26 is then installed using conventional hinge and lock mechanisms.

The cabinet construction of the present invention may accommodate any desired type of refrigeration system. The back panel 32 provides a convenient place for mounting the usual exterior condenser, and the back panel and liner are provided with complementary recesses 78 and 80, respectively, to accommodate a conventional compressor, both the condenser and compressor being installed after assembly of the cabinet.

What is claimed and desired to be secured by Letters Patent is:

1. In a refrigerator cabinet construction, a one-piece wraparound shell forming the top, side and bottom outer walls of said cabinet, said shell having overlapping portions at one bottom corner, a base assembly underlying the bottom wall of said cabinet, and attachment means including cooperating interfitting formations on said base assembly and said overlapping portions of said shell for securing said overlapping portions of said shell together while securing said base assembly to said shell.

2. A refrigerator cabinet construction according to claim 1 wherein said base is of one-piece wraparound construction having front, side and rear wall portions, the ends of said base being disposed at a rear corner of said cabinet, said attachment means also being effective to hold said base in assembled configuration.

3. A refrigerator cabinet construction comprising a one-piece wraparound shell forming the top, side and bottom walls of said cabinet, said shell having overlapping portions at one bottom corner, a base assembly, means securing said base assembly to said shell and securing said overlapping portions of said shell together, means forming an inwardly opening groove extending around the front edge of said shell, a liner having an outwardly extending peripheral flange received in said groove, means forming a rearwardly opening groove extending around the rearward edge of said shell, a back cover panel having a peripheral flange received in said groove, the main body portion of said liner being spaced inwardly from said shell and from said back cover plate, and insulation surrounding the main body portion of said liner.

4. The refrigerator cabinet according to claim 3 wherein said base has an inwardly extending top flange and said attaching means comprises a plurality of attaching formations upstruck from the body of said flange and extending through aligned openings in said overlapping shell portions.

5. The refrigerator cabinet according to claim 3 wherein said shell is formed with an inwardly opening groove extending around its front edge, together with a liner having an outwardly extending peripheral flange received in said groove.

6. The refrigerator cabinet according to claim 5 wherein said shell is formed with a rearwardly opening groove extending around its rearward edge, together with a back cover plate having a peripheral flange received in said rearwardly opening groove.

7. A refrigerator cabinet construction comprising a one-piece wraparound shell forming the top, side and bottom walls of said cabinet, said shell having overlapping portions at one bottom corner, a one-piece wraparound base construction, the ends of said base being disposed at the rear of said cabinet, said base having an inwardly extending top flange underlying the overlapping portions of said shell, a plurality of attaching formations upstruck from the body of said flange and extending through aligned openings in said overlapping shell portions for securing said overlapping shell portions together while also securing said base assembly to said shell and holding said base assembly in assembled configuration.

8. A refrigerator cabinet construction comprising a one-piece wraparound shell forming the top, side and bottom walls of said cabinet, said shell having overlapping portions at one bottom corner, a one-piece wraparound base assembly adapted to underlie the bottom wall of said shell, the ends of said base assembly being disposed at the rear of said shell, said base assembly having an inturned flange portion, attaching means including attaching formations upstruck from the body of said flange and extending through aligned openings in said overlapping shell portions for securing said overlapping portions of said shell together while securing said base assembly to said shell and retaining said base assembly in assembled configuration, means forming an inwardly opening groove extending around the front edge of said shell, a one-piece plastic liner having an outwardly extending peripheral flange received in said groove, means forming a rearwardly opening groove extending around the rearward edge of said shell, a one-piece back cover panel having a peripheral flange received in said groove, the main body portion of said liner being spaced inwardly from said shell and from said back cover plate, and insulation surrounding the main body portion of said shell and being effective to retain said back panel in assembled relation whereby said outer shell, said liner, said back panel and said base assembly are held in assembled relation without welds or other separate attachment means.

* * * * *